US006695001B2

(12) United States Patent
Dicosola

(10) Patent No.: US 6,695,001 B2
(45) Date of Patent: Feb. 24, 2004

(54) GAS CONNECTION HOUSING AND A METHOD OF CONSTRUCTING A GAS CONNECTION HOUSING

(76) Inventor: Nicola A. Dicosola, 345 Western Ave., Clarendon Hills, IL (US) 60514

( * ) Notice: Subject to any disclaimer, the term of this patent is extended or adjusted under 35 U.S.C. 154(b) by 91 days.

(21) Appl. No.: 09/918,344

(22) Filed: Jul. 30, 2001

(65) Prior Publication Data

US 2003/0019523 A1 Jan. 30, 2003

(51) Int. Cl.[7] ..... F16L 5/00
(52) U.S. Cl. ..... 137/360; 137/361
(58) Field of Search ..... 137/360, 361

(56) References Cited

U.S. PATENT DOCUMENTS

| | | | | |
|---|---|---|---|---|
| 793,931 A | | 7/1905 | Lodge et al. | |
| 945,753 A | | 1/1910 | Chamberlain et al. | |
| 1,585,084 A | * | 5/1926 | Cunningham | 137/361 |
| 2,952,271 A | | 9/1960 | Dick et al. | 137/360 |
| 3,096,782 A | | 7/1963 | Williams | 137/360 |
| 3,148,698 A | | 9/1964 | Arnold | 137/360 |
| 3,474,810 A | | 10/1969 | Welsh | 137/75 |
| 3,831,624 A | | 8/1974 | Doumany | 137/360 |
| 3,847,175 A | | 11/1974 | Anderson | 137/360 |
| 4,198,328 A | | 4/1980 | Bertelli et al. | 260/22 A |
| 4,410,004 A | | 10/1983 | Kifer et al. | 137/360 |
| 4,564,249 A | | 1/1986 | Logsdon | 312/229 |
| 4,879,320 A | | 11/1989 | Hastings | 523/179 |
| 5,261,444 A | | 11/1993 | Childers | 137/360 |
| 5,653,254 A | * | 8/1997 | Condon et al. | 137/360 |
| 5,875,812 A | | 3/1999 | Miller | 137/360 |
| 5,925,457 A | | 7/1999 | McGinniss et al. | 428/341 |
| 6,234,193 B1 | * | 5/2001 | Hobbs et al. | 137/360 |
| 6,419,102 B1 | * | 7/2002 | Harpenau | 137/360 |

OTHER PUBLICATIONS

Tracpipe® catalog [online]. Omegaflex® Inc., Sep. 1, 2000 [retreived Apr. 12, 2003]. Retrieved from the Internet: <URL: http://www.omegaflex.com/trac/wnglc.htm; http://www.omegaflex.com/trac./RES.pdf.>.*

* cited by examiner

*Primary Examiner*—John Fox
(74) *Attorney, Agent, or Firm*—Marshall, Gerstein & Borun LLP

(57) ABSTRACT

A housing for receiving a gas line, sized to fit behind the plane of a wall. The housing including a back member and a plurality of side members sealed along a plurality of seams to define a enclosure having an open face generally parallel to the back member. The enclosure defining an interior surface and an exterior surface and at least one of the interior surface and exterior surface including a fire resistant material. An orifice is located in at least one of the side members and the orifice is adapted to accept the gas line. At least one attachment member is adapted to permit the enclosure to be affixed to the wall.

18 Claims, 6 Drawing Sheets

GAS CONNECTION HOUSING AND A METHOD OF CONSTRUCTING A GAS CONNECTION HOUSING

FIELD OF THE INVENTION

The present invention relates generally to enclosures for receiving gas line connections and more specifically to an enclosure for installation within a wall and supporting a gas line connection within a wall.

BACKGROUND

In residential and/or commercial construction, appliances such as washers, dryers, hot water heaters, furnaces, stoves, gas grills etc., all require connection to one or more utilities, such as electricity, water, and/or gas in order to function. Convenient electrical connections are very well known. However, connections for water and gas lines are more problematic. Typically, gas and water lines are located within the walls or under the floors of a building, with appropriate sealed connections provided to the appliance at the point of use. The gas or water line typically protrudes from the wall or from the floor adjacent to or behind the location of the appliance.

Housings for water line connections are known. Such known housings typically place at least a portion of the water line connection behind the plane of the wall, allowing water using appliances (e.g., washers, refrigerators, or water coolers) to be positioned closer to the wall, to better utilize the available floor space. Such known housings are typically mounted to the wall studs after cutting a hole in the drywall, such that a face of the housing is roughly flush with the surface of the wall. A drainage connection may also be provided in such housings, with flexible water lines routing water to and from the appliance as needed.

For appliances requiring natural gas connections, the gas supply lines are also routed through the wall as described above. Unlike water lines, gas supply lines require heavier gauge piping, typically rigid piping commonly referred to as "black pipe." Gas supply lines also require much more secure connections, and require a shut-off valve at the terminus of the rigid piping to prevent the leakage of combustible gases. A typical gas supply line connection positioned outside of the plane of the wall is shown in FIGS. 1 and 2.

DETAILED DESCRIPTION

The following description of the disclosed embodiment is not intended to limit the scope of the invention to the precise form or forms detailed herein. Instead, the following description is intended to be illustrative of the principles of the invention so that others may follow its teachings.

Figure 2:
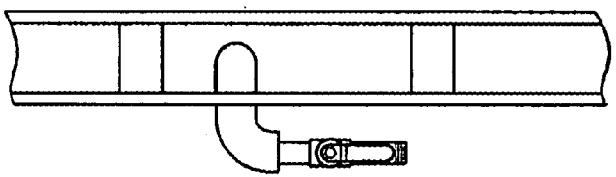
PRIOR ART FIG. 2
FIG. 2 is a plan view of the prior art gas supply connector illustrated in FIG. 1.
Figure 1:
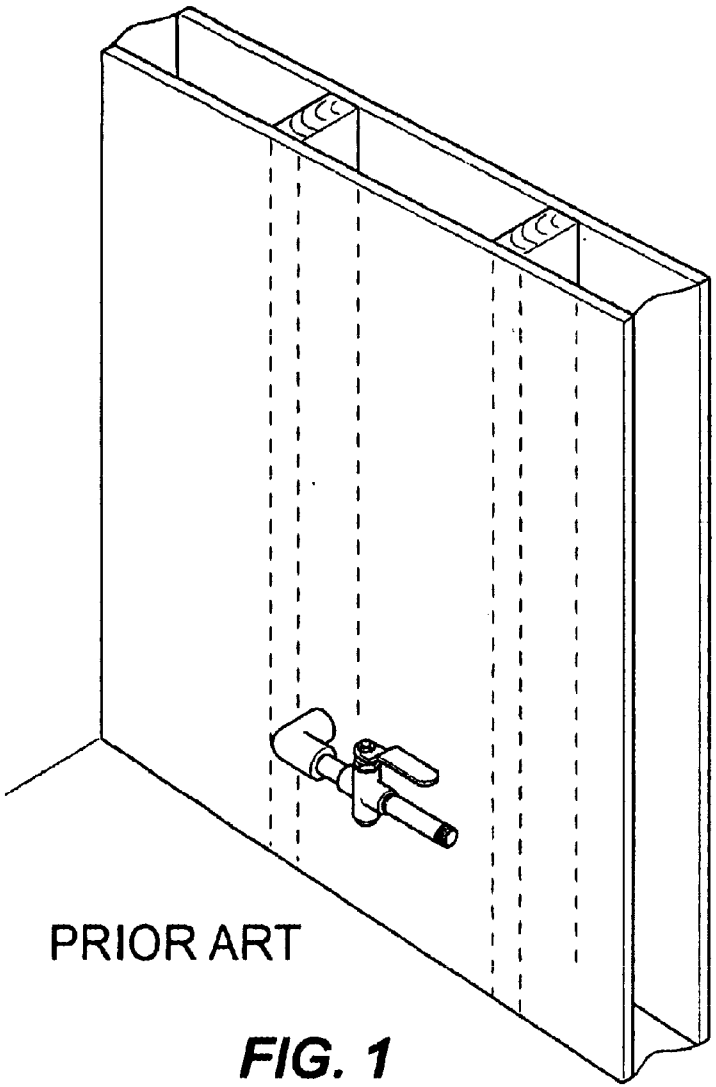
PRIOR ART FIG. 1
FIG. 1 is a perspective view of a prior art gas supply connector disposed outside of the plane of a wall.
Figure 3:
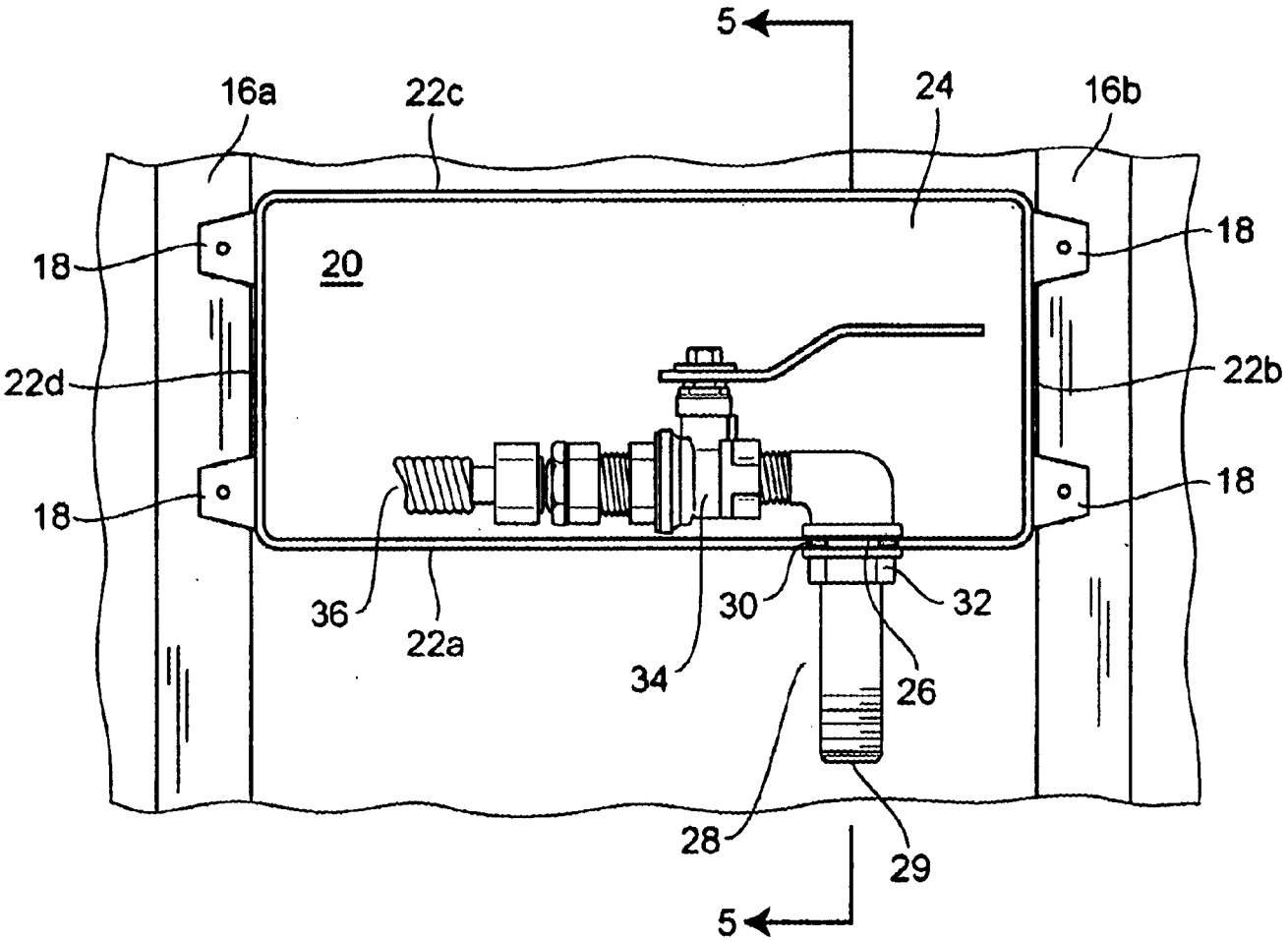
FIG. 3 is a front elevational view of a gas connection housing constructed in accordance with the teaching of the present invention.
Figure 5:
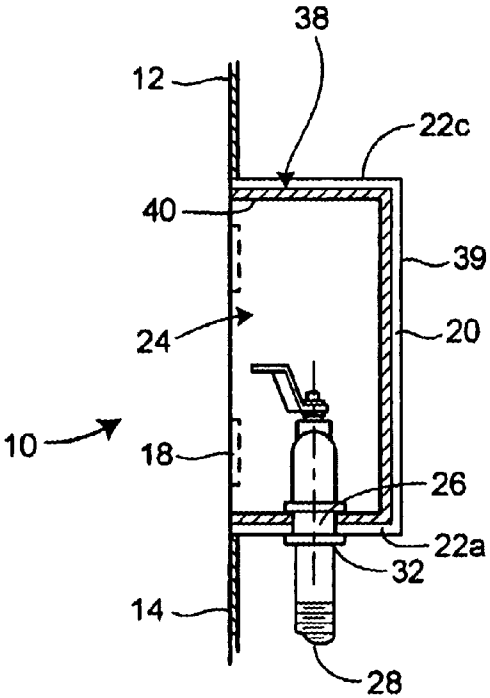
FIG. 5 is a cross-sectional view taken along line 5—5 of FIG. 3.

Referring now to the drawings, FIG. 3 illustrates a gas connection housing generally referred to by the reference numeral 10. The housing 10 may be constructed from a variety of materials including, but not limited to, sheet metal, ceramic or plastic, while the embodiments discussed herein are primarily of constructed of sheet metal for reasons of manufacturablity, these embodiments are intended to be illustrative only and not to limit the invention to any specific material. For ease of illustration, one possible intended use is illustrated in FIG. 5 in which the housing 10 is positioned behind a plane 12 defined by a surface of a wall 14. As shown therein, the housing 10 is permanently attached to a pair of wall studs 16*a* and 16*b* by a plurality of attachment members 18. Alternatively, the housing 10 may be provided with a peripheral flange (not shown) to aid in the attachment process.

Figure 4:
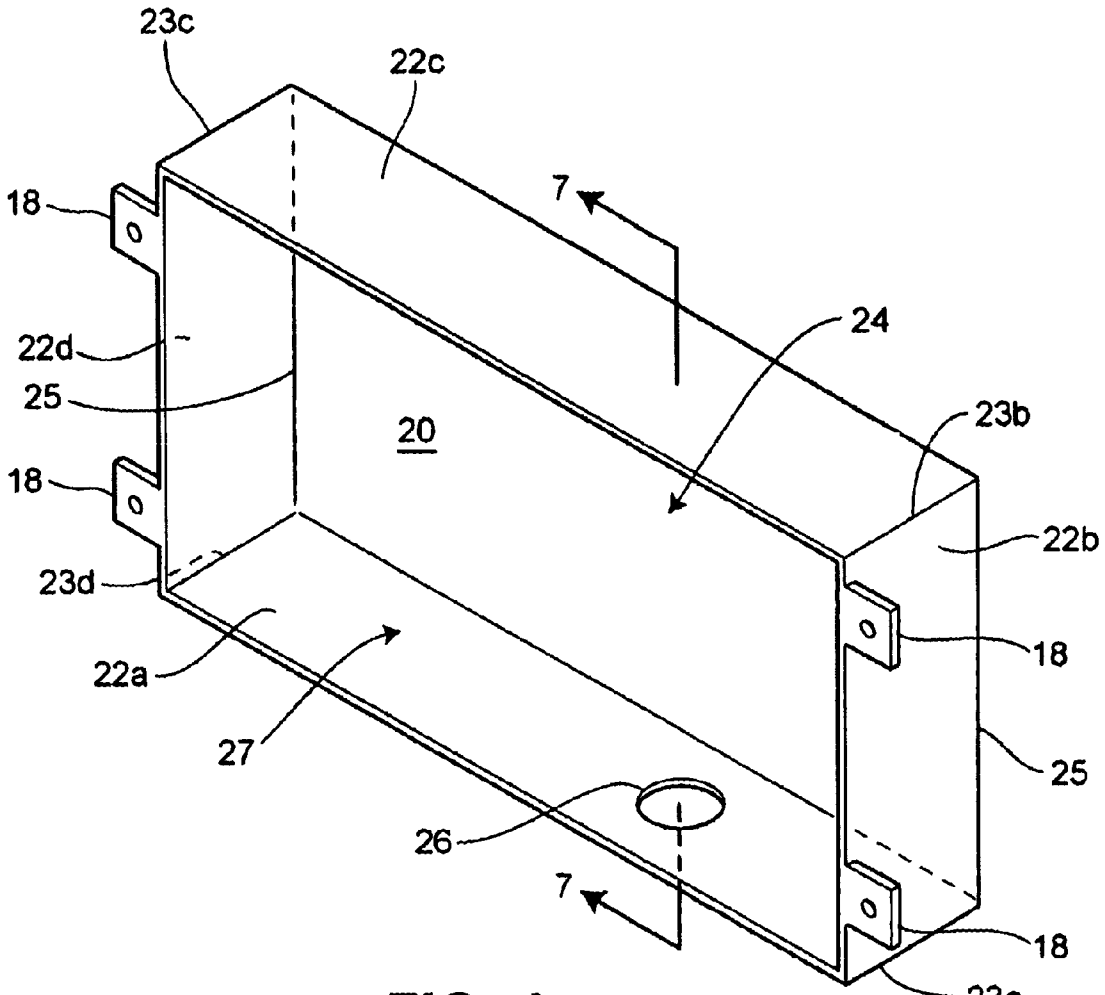
FIG. 4 is a perspective view of the housing illustrated in FIG. 3.

The housing 10 includes a back wall 20 and a plurality of side wall 22*a*, 22*b*, 22*c* and 22*d*. As illustrated in FIG. 4 the side walls 22*a* and 22*b* meet along a common seam 23*a*, the sidewalls 22*b* and 22*c* meet along a common seam 23*b*, the sidewalls 22*c* and 22*d* meet along a common seam 23*c*, and the sidewalls 22*d* and 22*a* meet along a common seam 23*d*. The back wall 20 meets each of the sidewalls 22*a*–22*d* along a common seam 25. Preferably, the seams 23*a*–23*d* and 25 are all impermeable or are otherwise sealed. Thus, the back wall 20 and the side walls 22*a*, 22*b*, 22*c*, 22*d* together form a sealed enclosure 24 having an open face 27.

At least one of the sidewalls 22*a*–22*d* includes an orifice 26 sized to accept a pipe section 28 (illustrated in detail in FIG. 3). The pipe section 28 is connected to the gas valve 34, and the gas valve 34 and the pipe section 28 are secured to the side wall 22*a* using a collar or other suitable connection hardware. The pipe section 28 includes an end 29 that is adapted for connection to a gas supply line (not shown). The orifice 26 may further include a gas impermeable sealing member 30 (illustrated in detail in FIG. 6). Thus, the gas supply line 28 may be fixedly attached to the side wall 22*a* so as to extend through the orifice 26. The gas supply line 28 may be secured to the side wall 22*a* by a conventional threaded collar 32.

It will be understood that the gas supply line 28 may, as an alternative, extend in a similar manner through an orifice formed in any one of the side walls 22*b*, 22*c*, 22*d*, or, as a still further alternative, through a similar orifice formed in the back wall 20 of the housing 10. The housing 10 may be sized so that a gas valve 34, illustrated in FIGS. 3 and 5, may be mounted within the enclosure 24. The gas valve 34 provides a connection for a utility supply line 36.

Figure 6:
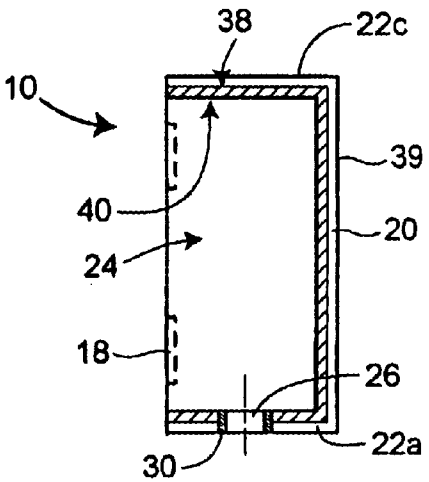
FIG. 6 is a cross-sectional view similar to FIG. 5.

The enclosure 24 includes an interior surface 38 and an exterior surface 39, which, in accordance with the first disclosed embodiment, includes a coating 40 of a fire retardant material as illustrated in FIGS. 5 and 6. The fire retardant material may be, by way of example rather than limitation, an intumescent material applied to either the interior surface 38, the exterior surface 39, or both the interior surface 38 and the exterior surface 39 of the enclosure 24. One possible intumescent material may be A/D Firefilm II® brand name, available from AD Fire Protection Systems.

Figure 8:
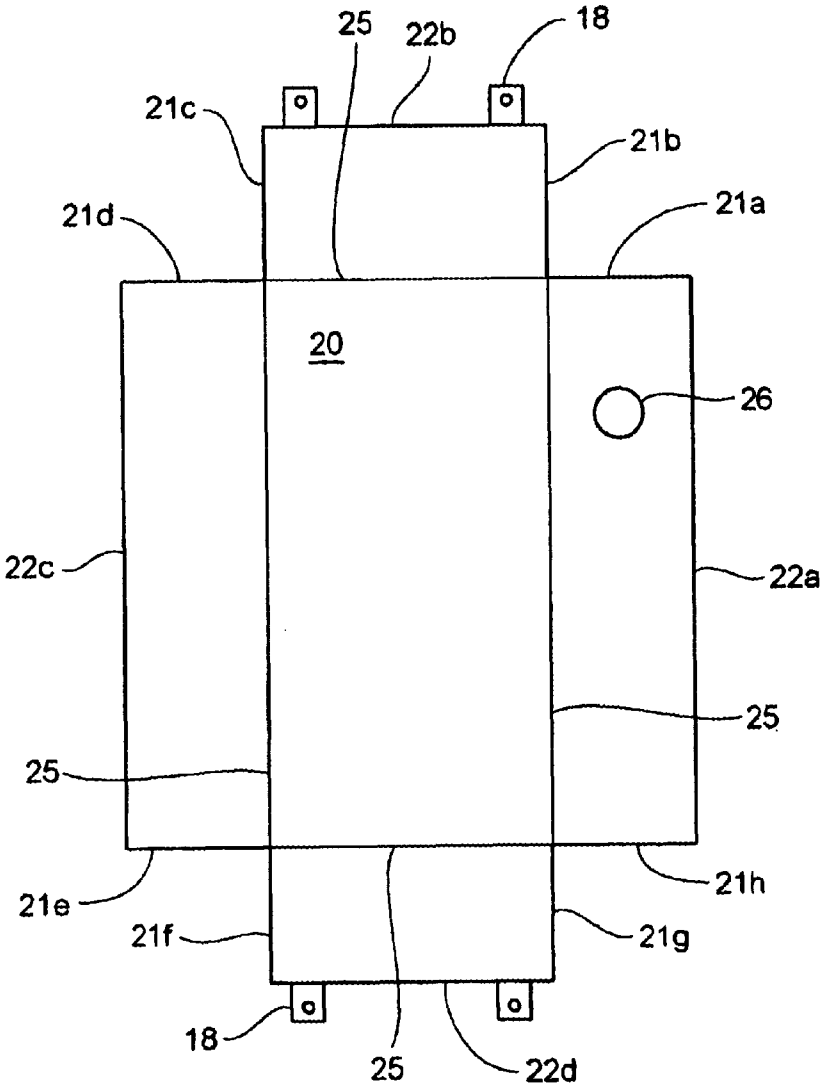
FIG. 8 is a plan view of an unassembled gas connection housing.

In operation, and referring to FIG. 8, the housing 10 may be formed from a section of precut sheet metal stock or other suitable material. The housing 10 may be formed by folding sidewalls 22*a*–22*d* along the seam 25. The sidewall 22*a* includes a pair of edges 21*a*, 21*h*. Similarly, the sidewall 22*b* includes a pair of edges 21*b*, 21*c*, the sidewall 22*c* includes a pair of edges 21*d*, 21*e*, and the sidewall 22*d* includes a pair of edges 21*f* and 21*g*. Upon folding of the sidewalls 22*a*–22*d* along the seam 25, the edges 21*a*, 21*b*, 21*c*, 21*d*, 21*e*, 21*f*, 21*g*, and 21*h* are brought into contact with their respective adjacent edges to form the seams 23*a*–23*d*, respectively. The seams 23*a*–23*d* may then sealed by any suitable technique, such as by welding, gluing, or using any other means of fastening.

As an alternative, the housing 10 may be stamped using conventional sheet metal forming techniques and may include a plurality of tabs (not shown) integral, by way of example, to the edges 21*a*, 21*c*, 21*e* and 21*h* and folded to engage a corresponding one of the adjacent sidewalls 22*a*–22*d* to form the seams 23*a*–23*d* which are preferably sealed as described above. The coating 40 may then be applied, preferably after forming the housing 10. The coating 40 may be sprayed on, or the housing 10 may be dipped. Other application techniques may be used as well.

Figure 9:
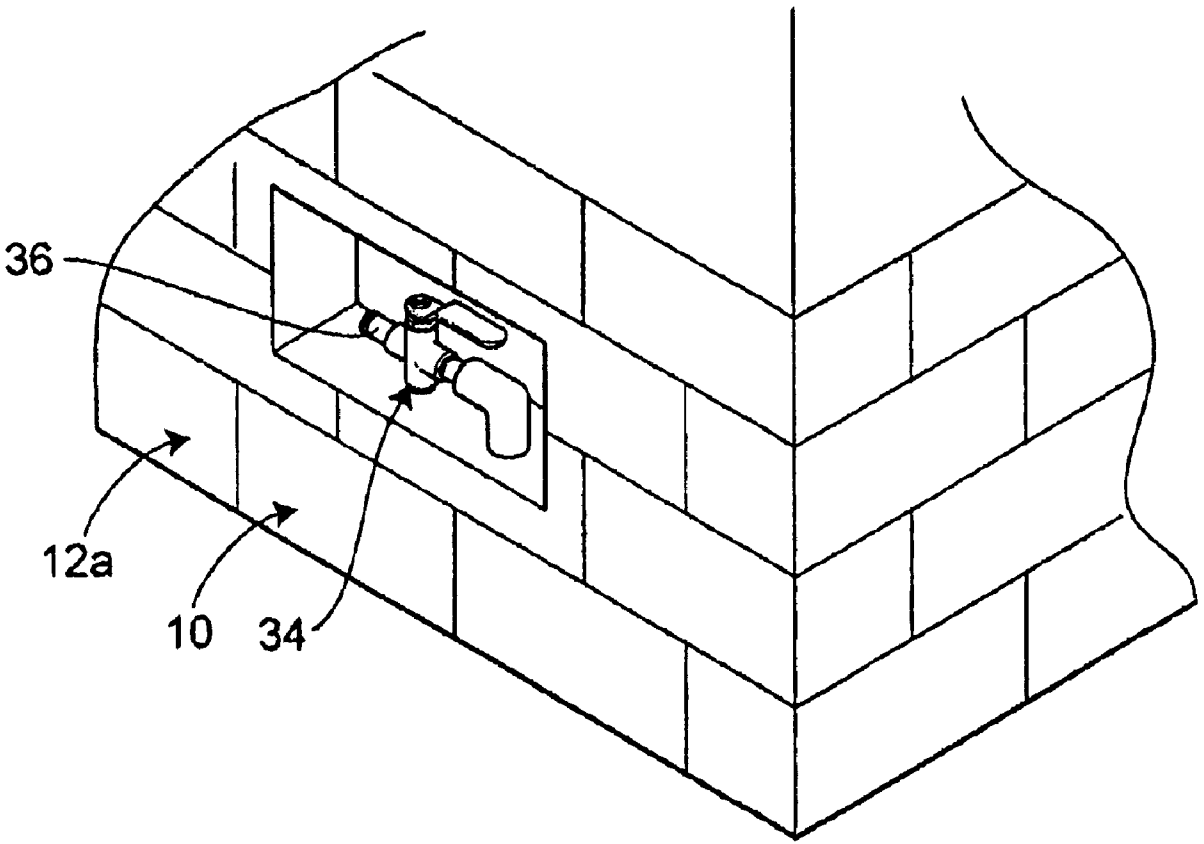
FIG. 9 is a perspective view of a gas connector housing disposed within the plane of an exterior wall.

Referring now to FIG. 9 the housing 10 is shown recessed in an exterior wall 12*a*. When so employed, the housing 10 permits the connection of an outdoor appliance such as a gas grill or gas heater to the exterior of the structure. The utility supply line 36 may be accomplished in a manner similar to the connections described above or, in the alternative, the utility supply line 36 may be made using a flexible piping system (not shown). One possible flexible piping system, made by Titeflex Corporation is available under the brand name Gastite®.

Figure 7:
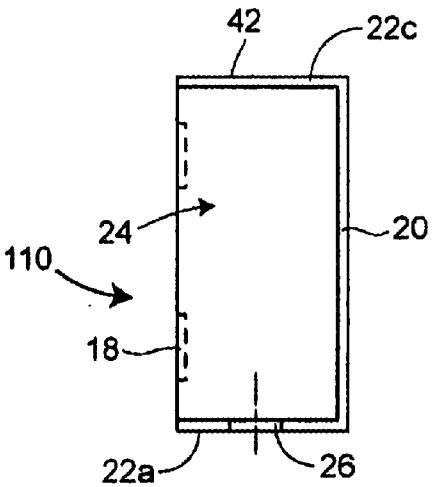
FIG. 7 is a cross-sectional view similar to FIG. 6 taken along the line 7—7 of FIG. 4 but showing a gas connection housing constructed in accordance with a second disclosed embodiment of the present invention.

Another embodiment is illustrated in FIG. 7, which depicts the housing 110 formed from a ceramic material 42. The housing 110 is similar in all other respects to the housing 10 discussed above. The ceramic material 42 chosen for the construction of the housing 110 may be capable of withstanding heat without the application of additional fire retardant materials.

The use of ceramic may offer certain advantages, including, by way of example rather than limitation, a reduction in the overall weight of the housing 110, which in turn makes the housing 110 easier to handle and install. In addition, when the housing 110 is formed from a ceramic material 42, the device may offer increased thermal and electrical insulating properties. The housing 110 may, as an option, also include a coating 40 as outlined above.

In use, when the thermal insulating and fire resistant or retardant materials are combined in the formation of a sealed enclosure, and with the addition of the gas impermeable sealing member 30, escaping gases may be effectively prevented from communicating beyond the confines of the enclosure. As a result, escaping gases may be effectively prevented from entering and being trapped behind the plane of the wall. This result may be highly desirable when dealing with a highly flammable substance such as, for example, natural gas, propane, etc.

Incorporating an intumescent material into the basic design of the housing 10 or 110 may offer a number of advantages, including, among other things, enhanced fire protection characteristics. When an intumescent coating is exposed to extreme heat, the coating expands to many times its original volume, thus creating a rigid foam. The inert gases trapped within the foam act as a highly efficient insulator to protect the structural integrity of the housing 10, 110 for a period of time. In the disclosed embodiment, the intumescent coating 40 may offer, for example, up to three hours of fire protection, in compliance with CAN/ULC-S101 and ASTM-E119 standards.

While the housings have been described herein with reference to specific examples, which are intended to be illustrative only and not to be limiting of the invention, it will be apparent to those of ordinary skill in the art that changes, additions or deletions may be made to the disclosed embodiments without departing from the spirit and scope of the invention.

What is claimed:

1. A housing for receiving a gas line, the housing sized to fit behind a plane of a wall, the housing comprising:

a back member;

a plurality of side members, the side members and the back member sealed along a plurality of seams to generally define an enclosure, the enclosure having an open face generally parallel to the back member;

the enclosure defining an interior surface and an exterior surface, at least one of the interior surface and the exterior surface comprising a fire resistant material;

a single orifice, the orifice located in at least one of the side members, the orifice adapted to accept the gas line containing a fuel gas and a gas line assembly, wherein the gas line assembly is communicatively connected to the gas line and includes a gas output valve and connector secured substantially parallel to the plane of the wall; and at least one attachment member, the at least one attachment member adapted to permit the enclosure to be affixed to the wall.

2. The housing of claim 1, wherein the back members and the plurality of side members are constructed of a ceramic material.

3. The housing of claim 1, wherein the back members and the plurality of side members are metallic.

4. The housing of claim 1, wherein the fire resistant material comprises a fire resistant coating applied to the interior surface.

5. A housing for receiving a gas line, the housing sized to fit behind a plane of a wall, the housing comprising:

a back member;

a plurality of side members, the side members and the back member sealed along a plurality of seams to generally define an enclosure, the enclosure having an open face generally parallel to the back member;

the enclosure defining an interior surface and an exterior surface, at least one of the interior surface and the exterior surface comprising an intumescent coating;

an orifice, the orifice located in at least one of the side members, the orifice adapted to accept the gas line; and at least one attachment member, the at least one attachment member adapted to permit the enclosure to be affixed to the wall.

6. The housing of claim 1, wherein the fire resistant material comprises a fire resistant coating applied to the exterior surface.

7. The housing of claim 6, wherein the fire resistant coating is an intumescent coating.

8. A housing for mounting within a wall and for receiving a gasline, the housing comprising:

a back wall;

a perimeter wall, the perimeter wall and back wall cooperating to define an enclosure having an open face, the perimeter wall and the back wall constructed of a fire resistant material;

an orifice, the orifice defined in a portion of the perimeter wall, the orifice adapted to receive a gas line assembly having a gas output valve and connector and communicatively connected to the gas line, wherein the gas line contains a fuel gas, the orifice arranged so that the gas line assembly is oriented parallel to a plane defined by a surface of the wall;

a seal surrounding the orifice, the seal adapted to prevent gas flow communication past the seal when the gas line assembly is disposed in the orifice; and a pair of attachment flanges carried by the perimeter wall, the attachment flanges adapted to facilitate attachment of the enclosure to the wall.

9. The housing of claim 8, the wall including a pair of spaced apart studs, and wherein the attachment flanges are spaced for attachment to the pair of studs.

10. The housing of claim 8, wherein the perimeter wall includes a top wall, a bottom wall and a pair of side walls, and wherein the enclosure is substantially rectilinear.

11. A housing for mounting within a wall and for receiving a gas line, the housing comprising:

a back wall;

a perimeter wall, the perimeter wall and back wall cooperating to define an enclosure having an open face and an interior surface and an exterior having a coating applied to at least one of the interior surface and the exterior surface, and further wherein the coating comprises an intumescent substance;

an orifice, the orifice defined in a portion of the perimeter wall, the orifice adapted to receive the gas line, the orifice arranged so that the gas line is oriented parallel to a plane defined by a surface of the wall;

a seal surrounding the orifice, the seal adapted to prevent gas flow communication past the seal when the gas line is disposed in the orifice; and a pair of attachment flanges carried by the perimeter wall, the attachment flanges adapted to facilitate attachment of the enclosure to the wall.

12. The housing of claim 8, wherein the fire resistant material is a ceramic.

13. A gas line housing for receiving a gas line connection within a recess formed within a wail, the gas line housing comprising:

a box-like enclosure, the box-like enclosure adapted for attachment to the wall with the box-like enclosure disposed within the recess, the box-like enclosure including an opening sized to receive the gas line, the box-like enclosure sized to receive the gas line connection; and an intumescent material, the intumescent material coating at least one of an interior surface and an exterior of the box-like enclosure.

14. The gas line housing in claim 13, the surface of the wall defining a plane, end wherein the box-like enclosure is sized so that the box-like enclosure resides entirely behind the plane.

15. The gas line housing in claim 13, wherein the fire insulating material is integrally formed with the box-like enclosure.

16. The gas line housing in claim 13, wherein the intumescent coating is applied to the interior surface of the box-like enclosure.

17. The gas line housing in claim 13, wherein the intumescent coating is applied to the exterior surface of the box-like enclosure.

18. A housing for receiving a gas line connection, the housing sized to fit within recess disposed in a wall, the housing comprising:

a back wall;

a top wall, a bottom wall, end a pair of side walls;

the back wall, the top wall, the bottom wall and the pair of side walls bonded along a plurality of seams to form an enclosure, the enclosure has an interior surface;

a fire resistant intumescent coating applied to the interior surface;

an orifice, the orifice located in a selected one of the top wall, the bottom wall and the pair of side walls, the orifice adapted to accept the gas line; and a pair of attachment members, the attachment members fixedly attached to the enclosure, the attachment members adapted to permit mounting of the enclosure to a pair of studs disposed within the wall.

* * * * *

UNITED STATES PATENT AND TRADEMARK OFFICE

CERTIFICATE OF CORRECTION

PATENT NO. : 6,695,001 B2
DATED : February 24, 2004
INVENTOR(S) : Nicola A. Dicosola It is certified that error appears in the above-identified patent and that said Letters Patent is hereby corrected as shown below:

Column 6,
Line 2, replace “wail” with -- wall --.
Line 14, replace “end” with -- and --.
Line 29, replace “end” with -- and --.

Signed and Sealed this

Twenty-first Day of December, 2004

JON W. DUDAS
*Director of the United States Patent and Trademark Office*